United States Patent [19]

Puder et al.

[11] Patent Number: 5,056,948

[45] Date of Patent: Oct. 15, 1991

[54] SCREEN CLEANING APPARATUS

[75] Inventors: Alan D. Puder; Carl W. Sims, both of St. Paul; Louis R. Hudoba, Fridley, all of

[73] Assignee: Northwest Screen Systems Co., Minneapolis, Minn.

[21] Appl. No.: 428,865

[22] Filed: Oct. 30, 1989

[51] Int. Cl.[5] ..... B08B 3/02

[52] U.S. Cl. ..... 401/143; 134/57 R; 134/111; 134/172; 401/146

[58] Field of Search ..... 134/57 R, 111, 172, 134/179, 180, 181; 401/143, 146

[56] References Cited

U.S. PATENT DOCUMENTS 3,656,493 4/1972 Black et al. ..... 134/172 X
4,807,654 2/1989 Jui-Chi et al. ..... 134/179
4,826,539 5/1989 Harpold ..... 134/179 X

OTHER PUBLICATIONS

Product literature (copy enclosed) for Screen-Reclaiming System Labelled HE43ERWT-1, dated May 1989.

*Primary Examiner*—Philip R. Coe
*Attorney, Agent, or Firm*—Merchant, Gould, Smith, Edell, Welter & Schmidt

[57] ABSTRACT

A screen printing plate cleaning cabinet comprising walls having an openable portion for placing a screen printing plate in the cabinet. A dispensing subsystem comprises a scanning spray head for discharging cleaning fluid against a screen printing plate and a filter and drain subsystem utilizes pneumatically powered pumps for removing residue and cleaning fluid and pumping the residue and cleaning fluid through filters.

15 Claims, 13 Drawing Sheets

| | SPRAY PUMP | DRAIN PUMP | SPRAY VALVE | BRUSH VALVE | TILT SWITCH | TIMER |
|---|---|---|---|---|---|---|
| WASH | ON | ON | ON | OFF | ON | ON |
| DRAIN | OFF | ON | OFF | OFF | OFF | OFF |
| BRUSH | ON | ON | OFF | ON | OFF | OFF |
| STOP | OFF | OFF | OFF | OFF | OFF | OFF |

FIG. 13

SCREEN CLEANING APPARATUS

TECHNICAL FIELD OF THE INVENTION

The present invention relates generally to a cleaning apparatus for cleaning screen printing plates and more particularly to an enclosed cabinet for cleaning screen printing plates.

SUMMARY OF THE INVENTION

A plastic housing or cabinet is provided within which a screen printing plate is completely inserted for cleaning. The cabinet comprises an internal bracket within which the screen printing plate is mounted and a hinged wall member provides access means for placement of the screen printing plate. Dispensing means for dispensing cleaning fluid is provided so that pressurized cleaning fluid is applied to a face of the screen printing plate to remove ink and other undesired debris. The cleaning fluid and debris exits the cabinet through a drain and is pumped through a filtration system for particulate separation and cleaning fluid recirculation.

BACKGROUND OF THE INVENTION

Within the field of silkscreen applications, a need exists for washing inks and other debris from screen printing plates. Removal of inks, and sometimes emulsions, is important in order to reuse screens. Means for cleaning screen printing plates include application of pressurized cleaning fluid against a face of each screen printing plate. The ink and any other debris is removed from the screen printing plate through either chemical action of the cleaning fluid, manual scrubbing force, or the hydraulic action of the pressurized fluid. Although various cleaning fluids are utilized, including water, preferred cleaning fluids comprise solvents of various chemical composition. Heretofore, preferred solvents included hydrocarbon content solvents and other chemical compositions which could create byproducts in the form of vapors having a potentially explosive content. Accordingly, the industry has required screen printing plate washing and cleaning machines which are explosion-proof. This has resulted in cleaning machines having very heavy structure and inefficient design. Indeed, these machines are typically constructed of metal, such as stainless steel. Such structures create numerous problems including corrosion concerns, chemical compatibility difficulties, location restrictions due to weight, and overall inconvenience relative to portability. The metal machines are also relatively expensive to manufacture.

As the technology relating to cleaning of screen printing plates has progressed, developments in the chemical composition of solvents have allowed movement toward greater use of biodegradable components. Use of biodegradable cleaning fluids or solvents in the screen printing plate cleaning cycle provides numerous advantages including lower volatility, water solubility, improved disposability, and overall decreased personal safety hazards. Moreover, governmental restrictions on toxic disposal of solvents and cleaning fluids often become less burdensome when utilizing biodegradable cleaning fluids. Whereas explosion proof structures are required with cleaning systems using potentially explosive solvents, a non-explosion-proof structure may be utilized with cleaning systems of a non-explosive nature.

What is needed therefore is an apparatus for cleaning screen printing plates which is constructed of substantially chemically inert materials relative to the chemical composition of solvents to be used, and which structure provides a lightweight sealed enclosure within which a screen printing plate may be inserted and spray cleaned.

What is further needed is a screen printing plate cleaning apparatus in the form of an enclosure having translucent wall materials conducive to more efficient inspection of screen printing plate cleanliness following a wash cycle.

What is further needed is a screen printing plate cleaning apparatus comprising efficient subsystems with fixed location automatic and programmable scanning spray heads and pneumatically driven and controlled pump means for providing power and drain capabilities to the cleaning apparatus.

What is even further needed is a screen printing plate cleaning apparatus comprising a plurality of fixed location scanning spray heads capable of alternating or switchable operation in order to maximize the efficient use of low power and low pressure pumping systems as well as to efficiently accommodate variously sized screen printing plates.

Other objects and advantages of the invention will appear from the following detailed description which, in connection with the accompanying drawings, discloses embodiments of the invention for purposes of illustration only and not for determination of the limits of the invention.

BRIEF DESCRIPTION OF THE DRAWINGS

FIG. 13 illustrates a digital control logic scheme for a cleaning cabinet according to the present invention.

DETAILED DESCRIPTION OF THE INVENTION

As required, detailed embodiments of the present invention are disclosed herein. It is to be understood, however, that the disclosed embodiments are merely exemplary of the invention which may be embodied in various forms. Therefore, specific structural and functional details disclosed herein are not to be interpreted as limiting, but rather as a basis for teaching one skilled in the art to variously employ the present invention in virtually any appropriately detailed system or structure.

Figure 1:
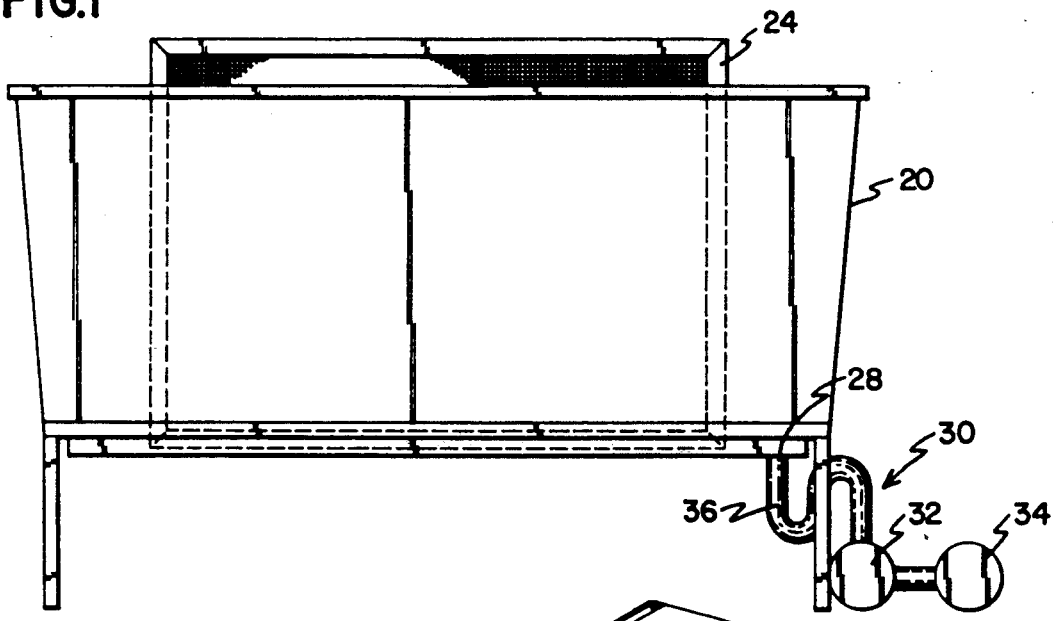
FIG. 1 is a front elevation view of a representative conventional spray basin having a modular add on pump and filtration subsystem according to the present invention.

Referring to FIG. 1, a representative wash spray basin 20 is shown. Wash spray basin 20 represents current wash spray basins used throughout many industries, including use as a cleaning basin for screen printing plates such as screen printing plate 24. In operation, screen printing plate 24 is placed in wash spray basin 20 for removal of excess ink, emulsion, or other debris therefrom. The removal process may be accomplished in a number of ways. Often, screen printing plates 24 are cleaned by use of high pressure cleaning fluids applied within the basin or through manual scrubbing action.

A particular problem occurs with wash spray basins 20 wherein toxic or hazardous cleaning fluids are utilized. This problem not only relates to personnel handling hazards but also to toxic waste disposal. Common byproducts which are removed during this washing or cleaning process include heavy metals such as lead or chromium based ink pigments. It is increasingly important that such heavy metals or toxic materials be captured and prevented from being washed down a drain or possibly discharged into uncontrolled areas. Current wash spray basins do not typically include readily available add-on features which will capture such heavy metals or similar debris. What has been needed therefore has been a modular or portable system or kit which may be readily attached or adapted to wash spray basins such as that shown in FIG. 1 to capture and control hazardous waste disposal resulting from screen printing plate cleaning processes.

Accordingly, FIG. 1 illustrates wash spray basin 20 with an attached modular drain filtration system. In particular, wash spray basin 20 includes a drain location 28 in the form of a conventional drain hole or access chamber which may be typically located at any gravity drain site in wash spray basin 20. Connected to drain location 28 is a modular and pneumatically powered portable filtration and drain system 30. Modular filtration and drain system 30 may be rapidly connected or disconnected as necessary to wash spray basin 20. Modular filtration and drain system 30 preferably comprises pump means 32, filtration means 34, and conduit means for modularly connecting pump means 32 to wash spray basin 20. Pump means 32 preferably comprises a pneumatic pump constructed and arranged for draining a biodegradable cleaning fluid from screen printing plate wash spray basin 20. Although this system will operate effectively in cooperation with non-biodegradable cleaning fluid, the efficiency is derived particularly from the ability to filter heavy metals from a biodegradable cleaning fluid and then to utilize conventional drains for disposal of the biodegradable cleaning fluid itself. Appropriately powered pneumatic supply means of conventional nature may be connected to pump means 32 for controlling and powering pump means 32. Preferred descriptions of pump means 32 will be later discussed herein, however, it should be noted that air operated pump means 32 provides excellent reliability while minimizing power requirements and pump down time. Further, internal component materials of pump means 32 may require matching with the chemical solvents to be utilized in the cleaning process. For example, certain rubber components may need to be replaced with or matched with a Teflon® type of material or other materials in order to prevent corrosive action within pump means 32 and related assemblies. This matching may be readily accomplished and should present little difficulty when the need is acknowledged in advance of system hookup and operation.

Filtration means 34 preferably comprises bag filters, or the like, which may be of varying filtration capabilities. Filtration means 34 filters the biodegradable cleaning fluid and traps debris cleaned from screen printing plate 24. Various configurations of filtration means 34 may be utilized to permit removal and replacement of filtration means 34. Conduit means 36 is provided for connecting wash spray basin 20 drain location 28 with pump means 32 and filtration means 34. Depending on the solvent and cleaning agent to be utilized, certain conduit means material characteristics may be desired. For example, a fiber reinforced braided hose of non-corrosive polypropylene or similar material might be utilized.

Figure 2:
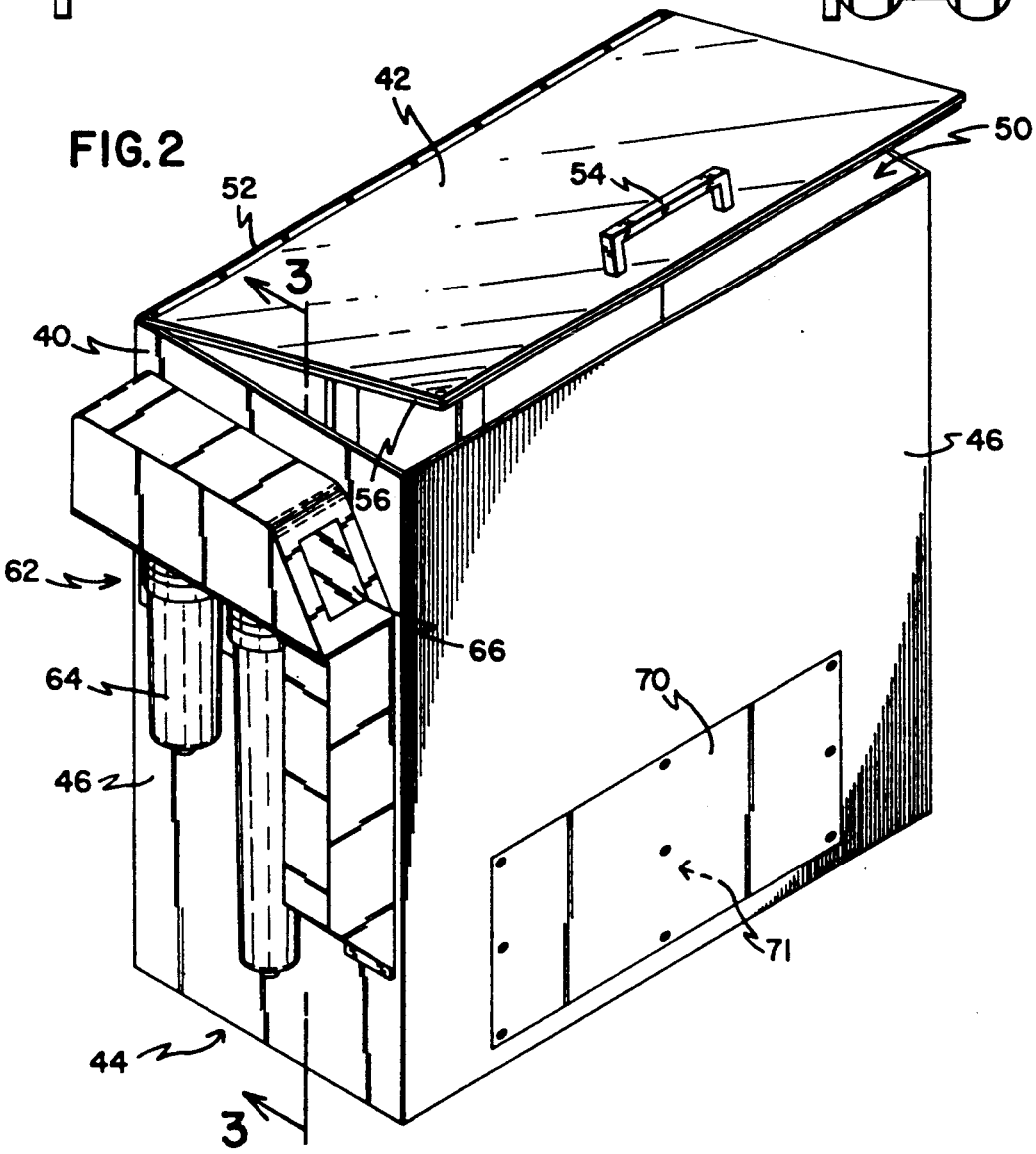
FIG. 2 is a front perspective view of a partially opened screen printing plate cleaning cabinet.

Referring now to FIG. 2, a front perspective view of a partially opened screen printing plate cleaning apparatus in the form of a cleaning cabinet 40 is shown. Screen printing plate cleaning cabinet 40 is designed to provide a completely enclosed structure within which a screen printing plate 24 (shown in FIG. 1 and other figures) may be placed and cleaned of any residual ink, emulsion, or other debris. Cleaning cabinet 40 provides greatly improved means for cleaning screen printing plates by incorporating numerous advantageous features such as low lift-over heights, a substantially closed-loop solvent recirculation and filtration system, translucent wall member portions to facilitate lighting and inspection of screen printing plates therein, low power and low pressure requirements for supply and drain pumps, lightweight material construction, highly efficient space utilization of screen printing plates inserted therein, scanning spray head dispensing means for dispensing cleaning fluids in a manner mimicking or similar to a manual operator, automatic and programmable switching means for accommodating variously sized screen printing plates, and numerous other advantages which will be discussed herein.

The screen printing plate cleaning cabinet 40 illustrated in FIG. 2 comprises wall means having a top wall 42, a bottom wall 44, and sidewalls 46 constructed and arranged to provide a fluid tight internal chamber 50 comprising a washing chamber or location for screen printing plates 24. Access means is provided extending through one or more of the various walls in order to position a screen printing plate 24 in internal chamber 50. As illustrated in FIG. 2, access means are provided by use of a hinge 52 arranged so that top wall 42 may be lifted vertically by handle means 54. Various hinge arrangements may be utilized, however, preferred cleaning cabinet 40 comprises a living hinge arrangement and antisplash means such that top wall 42 comprises a subtending splash wall 56 extending into internal chamber 50 when top wall 42 is in a closed position. Splash wall 56 thus prevents spillage or out splashing of any cleaning fluid during a cleaning cycle. Various other hinge or splash prevention combinations may be utilized within the spirit and scope of this invention.

Retaining means is preferably located within internal chamber 50 to receive and retain a screen printing plate 24 therein. Retaining means may comprise rail and platform configurations which will be further discussed in relation to other figures herein. Other features of preferred cleaning cabinet 40 illustrated in FIG. 2 include side mounted filtration means 62 comprising a plurality of filter canisters 64 constructed and arranged, preferably, to contain filter material of varying filtration characteristics to filter cleaning fluid effluent drained from internal chamber 50 and to remove toxic materials from said effluent. A control and logic entry touch pad 66 is provided for touch pad operation and digital programmable control of the cleaning systems of cleaning cabinet 40. Additional discussion relating to the control and logic subsystems of this invention are contained with the discussion relating to FIG. 13 and elsewhere. Also, front access panel 70 is provided to enhance accessibility of the various pumping systems normally located beneath internal chamber 50 in equipment cavity 71.

Figure 3:
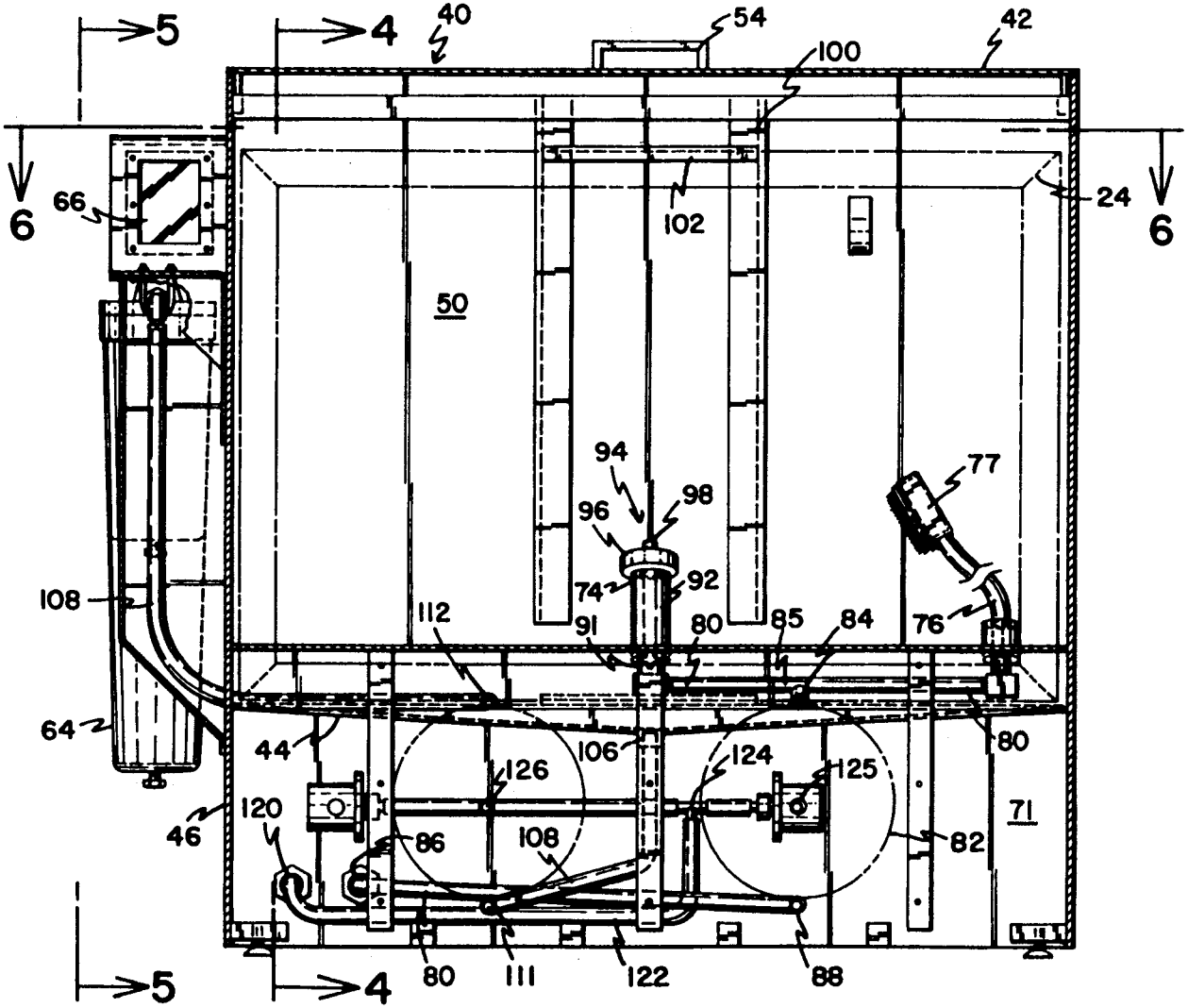
FIG. 3 is a front elevation view of the cleaning cabinet of FIG. 2 taken generally along lines 3—3 of FIG. 2.

FIG. 3 is a front elevation view of cleaning cabinet 40. FIG. 3 is a sectional view taken generally along lines 3—3 of FIG. 2, but with top wall 42 shown in a closed position rather than partially open as in FIG. 2. FIG. 3 provides further detail of the dispensing subsystem and filter and drain subsystem. In particular, screen printing plate cleaning cabinet 40 comprises a dispensing subsystem having spray head means 74 and, for optional use, a manual scrubber connection 76. The dispensing subsystem further comprises conduits or hoses 80 providing connection with cleaning fluid supply pump 82. Dispensing subsystem hoses 80 connect to cleaning fluid supply pump 82 at supply pump outlet location 84. A three way line or T connection (shown at 85) is preferably used to distribute cleaning fluid between spray head means 74 and manual scrubber connection 76. Manual scrubber connection 76 may comprise a hose as shown in FIG. 3 or a coiled hose of convention structure. Cleaning fluids pass through the hose into a substantially common variety scrub brush 77. Scrub brush 77 preferably comprises a fluid flow-through scrub brush constructed of resilient matter having chemically resistant properties. A cleaning fluid reservoir may be located within the equipment cavity 71 or it may preferably be located external of both equipment cavity 71 and the entire cleaning cabinet 40 itself. In such latter case, as correspondingly illustrated in FIG. 3, a cleaning fluid or solvent supply connection 86 is provided. Supply hose 80 then provides further connection to cleaning fluid supply pump 82 at supply pump intake location 88.

As further shown in FIG. 3, means are provided for dispensing cleaning fluids or solvents within internal chamber 50 of screen printing plate cleaning cabinet 40. Preferred spray head means 74 comprises connection means or sleeve 91 for connecting supply hose 80 with stand pipe 92. Stand pipe 92 comprises a fixed location stand pipe to which is connected a scanning spray head 94. Scanning spray head 94 essentially comprises technology related to conventional lawn sprinklers which utilize the force of fluid discharge to operate a hammer-like mechanism. This hammer-like mechanism is shown in simplified form here as rotary-like sleeve 96. In a lawn sprinkler, a hammer mechanism provides force against a sprinkler main assembly which induces a rotational effect on the nozzle. Although the concept is similarly used in this invention, various structural alterations have been implemented in order to incorporate the concept into this screen printing plate cleaning cabinet 40 invention. As a result, nozzle 98 may be preprogrammed to provide a variety of predetermined cleaning fluid spray patterns for application against variously sized and shaped screen printing plates 24. As will be later discussed in greater detail relating to FIGS. 14–17, this novel application of modified spray and nozzle technology substantially simulates the actual spray patterns which a manual operator would employ to most efficiently spray clean a screen printing plate 24. FIG. 3 further illustrates means for removing cleaning fluid and debris cleaned from the screen printing plate 24 and which has collected in a bottom area of internal chamber 50. More particularly, filter and drain subsystem means is provided for removing residue and cleaning fluid from said internal chamber. The filter and drain subsystem means comprises a cleaning cabinet 40 bottom wall 44 which is canted or pitched to provide appropriate run-off angles for cleaning fluid. The cant or pitch may be determined depending on actual applications in order to provide the most efficient drainage of cleaning fluid and debris from a screen printing plate being cleaned. It is also advantageous to employ screen printing plate 24 retaining means (such as retaining rail 100 and retaining platform 102) to position screen printing plate 24 for optimum runoff. Such positioning may include imparting a slight tilt to the screen printing plate away from the vertical to further enhance fluid runoff. In any event, preferred cleaning cabinet 40 filter and drain subsystem means permits gravity drain of runoff cleaning fluids through drain location 106 and into drain hose line 108. Drain hose line 108 connects with drain pump 110 at drain pump intake location 111. Drain pump 110 then pumps the cleaning fluid and residue through drain pump outlet connection 112 through yet another drain hose line 108 and into filtration means comprising various filter configurations.

Preferably, drain pump 110 and cleaning fluid supply pump 82 are each air driven pumps. These air driven pumps provide an increased level of safety to operators not found in other types of equipment. In particular, screen printing industry work areas typically may have explosive or flammable vapors present which may not be readily known or identifiable. The use of conventional electrical pumps may present unnecessary hazards with respect to sparking and possible explosion when located in explosive hazardous work areas. Accordingly, the air driven pumps offer a greater level of operational safety which has heretofore not been employed in a screen printing plate cleaning machine. A preferred air driven pump comprises a pump manufactured under the trade name of a Wilden ® brand pump. This pump is constructed so that pressurized air is applied directly to the liquid column being pumped, with separation between the mediums achieved by elastomer diaphragms. This balanced configuration substantially removes the mechanical stress from the diaphragms to permit longer life for the diaphragms. The pump can also run dry without damage, and even abrasive particles may be pumped with very little wear effect on pump components.

The structure of the cleaning system disclosed in the present invention employs efficient means for dispensing cleaning fluid not known or taught by other systems. More particularly, some screen washers use multiple spray heads mounted on spray bars which distribute cleaning solvent or cleaning fluid against a screen printing plate simultaneously. Such multiple head systems require very high volume pumps driven by relatively large horsepower electric motors. In contrast, scanning spray head 94 described and claimed herein focuses cleaning fluid spray in a shape which sweeps the surface or face of screen printing plate 24 in nearly the same way as an operator would clean the screen using a manual spray. This focused scanning spray ensures both maximum impact and thorough cleaning action. Additionally, if cleaning cabinet 40 is to be used routinely to wash small size screens, then the scanning spray has finger adjustable limits to ensure that the spray is directed to only the area of the screen rather than the screen plus adjacent wall areas of internal chamber 50. This more accurate use of scanning spray head 94 over other known systems provides greater system flexibility, less waste, and a reduction of wash times.

The distribution of the pneumatic control and power is shown in FIG. 3. First, the present invention requires only a relatively low pressure pneumatic source, such as approximately 100 pounds per square inch. A remote source is preferably utilized and connected to cleaning cabinet 40 at air supply connection 120. Air supply hose 122 routes the air supply to an air supply three way connection or T connection 124 which permits distribution to a supply pump air inlet 125 and a drain pump air inlet 126. The use of air driven pumps allow substantial advantages. For example, both the drain pump 110 and the cleaning fluid supply pump 82 will operate at whatever pressure is supplied to the pump. A preferred range of reservoir compressed air pressure provided to air supply connection 120 is approximately 60–110 pounds per square inch at a volume of 12–25 cubic feet per minute. Other ranges may be acceptable depending on the particular application and sizing requirements of the system. Yet another advantage of pneumatic or air driven pumps includes the ability to flow restrict the air to the pump without degrading the pump characteristics or operation. Similarly, if the outlet of a pump is clogged or stopped, then the pump will slow or stop without experiencing adverse effects on pump internals. In other words, this type of pump will usually neither seize nor experience internal damage which could substantially shut down the entire cleaning system. Also, these pump types tolerate a greater flow through of debris prior to shutdown than many other types of pumps.

Cleaning fluid supply pump 82 comprises a double air actuated diaphragm pump which optimally pumps 12–13 gallons per minute of cleaning fluid at 100 pounds per square inch pressure. The pump is also operable at a flow rate of 8 gallons per minute with certain back pressure. These capabilities are typically only met by other types of pumps having 2–5 horsepower electric motor characteristics. Once again, use of the air driven pumps in combination with this cleaning cabinet and washing system provides a safer alternative then electric drive pumps which may experience open sparking or other difficulties considered unacceptable to the normal work environment of screen cleaning operations.

Figure 4:
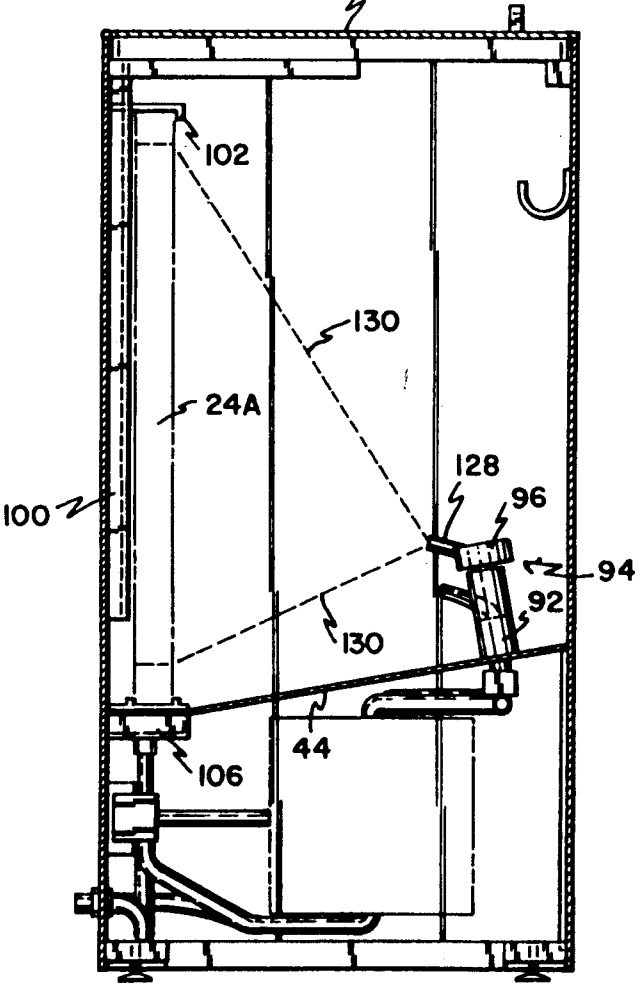
FIG. 4 is a side elevation cutaway view of the cleaning cabinet of FIG. 3, taken generally along lines 4—4 of FIG. 3.

FIG. 4 is a side elevation cutaway view taken generally along lines 4—4 of FIG. 3. FIG. 4 illustrates one embodiment of scanning spray head 94 in which nozzle 128 is constructed and arranged to provide vertical coverage in the form of a spray pattern range 130 designed for complete vertical coverage of screen printing plate screen area 24*a*. FIG. 4 also illustrates an embodiment of the slope incorporated into bottom wall 44 to provide gravity draining of cleaning fluid into drain location 106.

Figure 5:
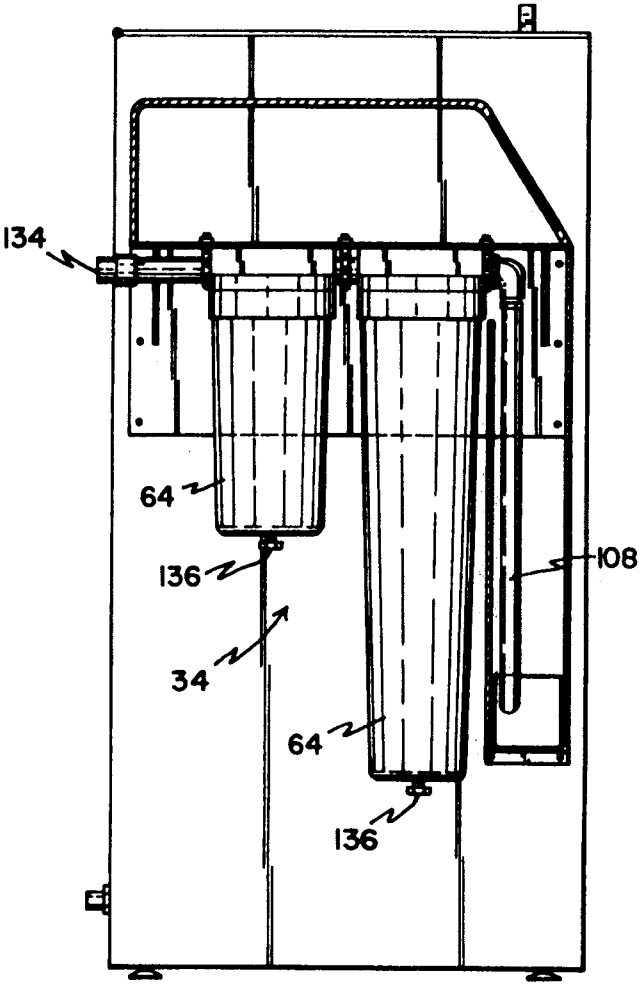
FIG. 5 is a side elevation view of the cleaning cabinet illustrated in FIG. 3 taken generally along lines 5—5 of FIG. 3.

FIG. 5 provides further detail of filtration means 34 earlier discussed and illustrated in FIG. 2. Filtration means 34 comprises, in a preferred embodiment, a pair of bag filters located within filter canisters 64. Drain hose line 108 provides means for transferring the pumped cleaning fluid or solvents (plus residue) from within internal chamber 50 to filtration means 34. Drain hose line 108 delivers the fluids consecutively to each of the filter canisters. Within each of the filter canisters 64, bag filters or the like provide filtration of the fluid and separate the toxic/particulate matter from the recyclable cleaning fluids. In a preferred embodiment, a first filter comprises filter bag means suitable for removing a first particulate size and a second filter bag means comprises a finer grade of filter bag material to further trap even finer or smaller size particulate matter. Then, the filtered cleaning fluid is discharged via discharge hose line 134 into a reservoir tank or directly into the recycling system. Filter canister 64 may be constructed of filled or high density polypropylene, but may also be manufactured of other substances. FIG. 5 also shows drain cock means 136 located at the base or gravity low point of each filter canister 64. Preferred filter canister 64 also comprises threadably attachable portions to enhance ease of assembly, removal, and replacement of clogged filter baskets or bags.

What has been shown therefore in FIGS. 1–5 is a pneumatically powered portable filtration and drain system for modular connection with a screen printing plate wash spray basin comprising pump means, filtration means, and conduit means. The pump means comprises a pneumatic pump constructed and arranged for draining a biodegradable cleaning fluid from a screen printing plate wash spray basin 20. The filtration means is provided for filtering the biodegradable cleaning fluid and for trapping debris cleaned from a screen printing plate 24 located in wash spray basin 20. Conduit means is provided for modularly connecting the pump means to the wash spray basin. Also disclosed is a screen printing plate cleaning cabinet 40 comprising wall means, access means extending through the wall means for positioning a screen plate in an internal chamber 50, retaining means within internal chamber 50, filter and drain subsystem means, and a dispensing subsystem. The wall means preferably comprise a top wall 42, a bottom wall 44, and side walls 46 all constructed and arranged to provide a fluid tight internal chamber 50 suitable for cleaning a screen printing plate 24 therein. Preferred wall means comprise translucent material. Indeed, wall means translucent material further preferably comprises material selected from the group consisting of non-filled polyethylene, non-filled polypropylene, polymethylpentine, polyolefin, polystyrene, and polysulfone. A cleaning cabinet 40 having portions constructed of any of the above wall means translucent material provides substantial advantages when viewing a screen printing plate during or following a washing operation. This advantage is further enhanced through use of appropriate back lighting providing additional light through said wall means. The access means extending through the wall means for positioning a screen printing plate in internal chamber 50 may comprise an openable hinged top wall 42 or an openable hinged sidewall portion. Such a sidewall portion may further comprise roller means 140 for assisting in sliding a screen printing plate into internal chamber 50. Use of sidewall access means may typically coincide with cleaning operations involving very large size or awkwardly sized screen printing plates 24.

A preferred dispensing subsystem comprises spray head means having a first single point scanning spray head 94 for discharging a cleaning fluid against a screen printing plate 24 first side. Spray head means 74 may preferably comprise a self-powered scanning spray head 94 or an independently powered and programmably controlled scanning spray head 94. Yet another embodiment of a dispensing subsystem according to the present invention comprises a plurality of single point scanning spray heads located in fixed position within internal chamber 50. Additionally, the dispensing subsystem according to this invention preferably also comprises a manually operated chemically resistent flow through scrub brush usable for removing ink or other debris stubbornly attached to screen printing plate 24, or to other tools or equipment. The filter and drain subsystem preferably comprises air driven pumps and piping means constructed and arranged for recirculation and reuse of cleaning fluid.

An advantage of utilizing biodegradable and substantially non-explosive cleaning fluids relates to the lightweight structure which may comprise a cleaning cabinet 40. However, by incorporating additional efficiencies into the cleaning operation, then the overall advantage of using subsystems relating to cleaning cabinet 40 is greatly enhanced. Accordingly, a low pressure solvent cleaning system for cleaning screen printing plates comprises cabinet means having single thickness plastic wall members constructed and arranged for providing a fluid tight internal chamber, access means located in a portion of the wall members to provide access into the cabinet means internal chamber for placement and removal of a screen printing plate, a dispensing subsystem comprising a scanning spray head for low pressure discharge of a cleaning fluid against a screen printing plate located within the cabinet means internal chamber, and filter and drain subsystem means connected to the cabinet means for removing residue and cleaning fluid from the cabinet means internal chamber. In such a system, the dispensing subsystem may dispense cleaning fluid at a pressure of only about 100 pounds per square inch.

Figure 6:
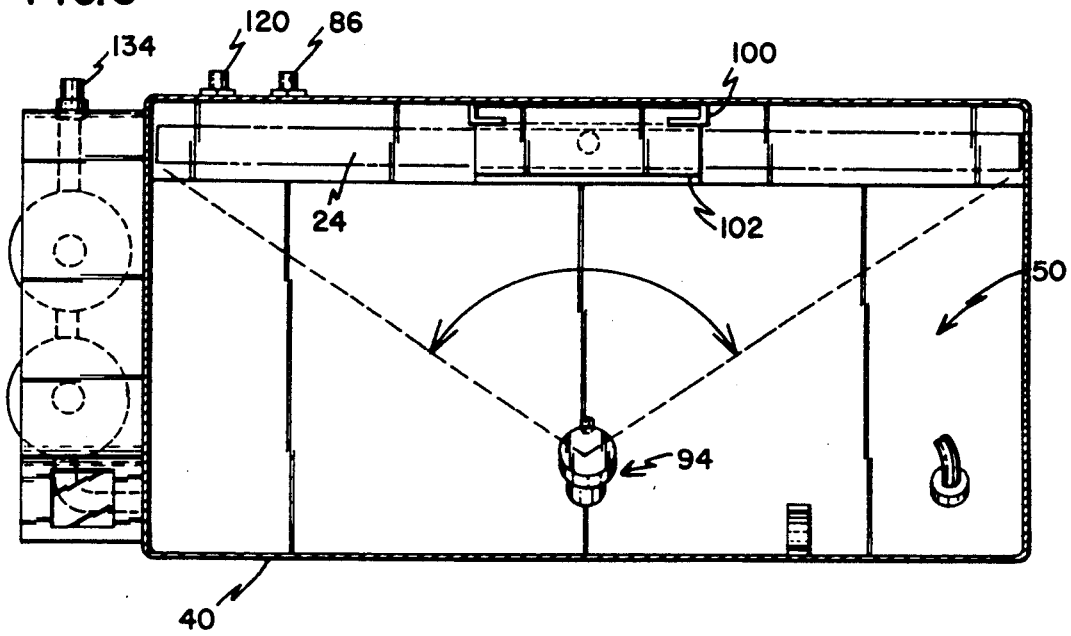
FIG. 6 is a top plan view of the cleaning cabinet illustrated in FIG. 3 taken generally along lines 6—6 of FIG. 3.

FIG. 6 is a top plan view of the cleaning cabinet illustrated in FIGS. 2-5. FIG. 6 illustrates a preferred scanning arc of spray for scanning spray head 94.

Figure 7:
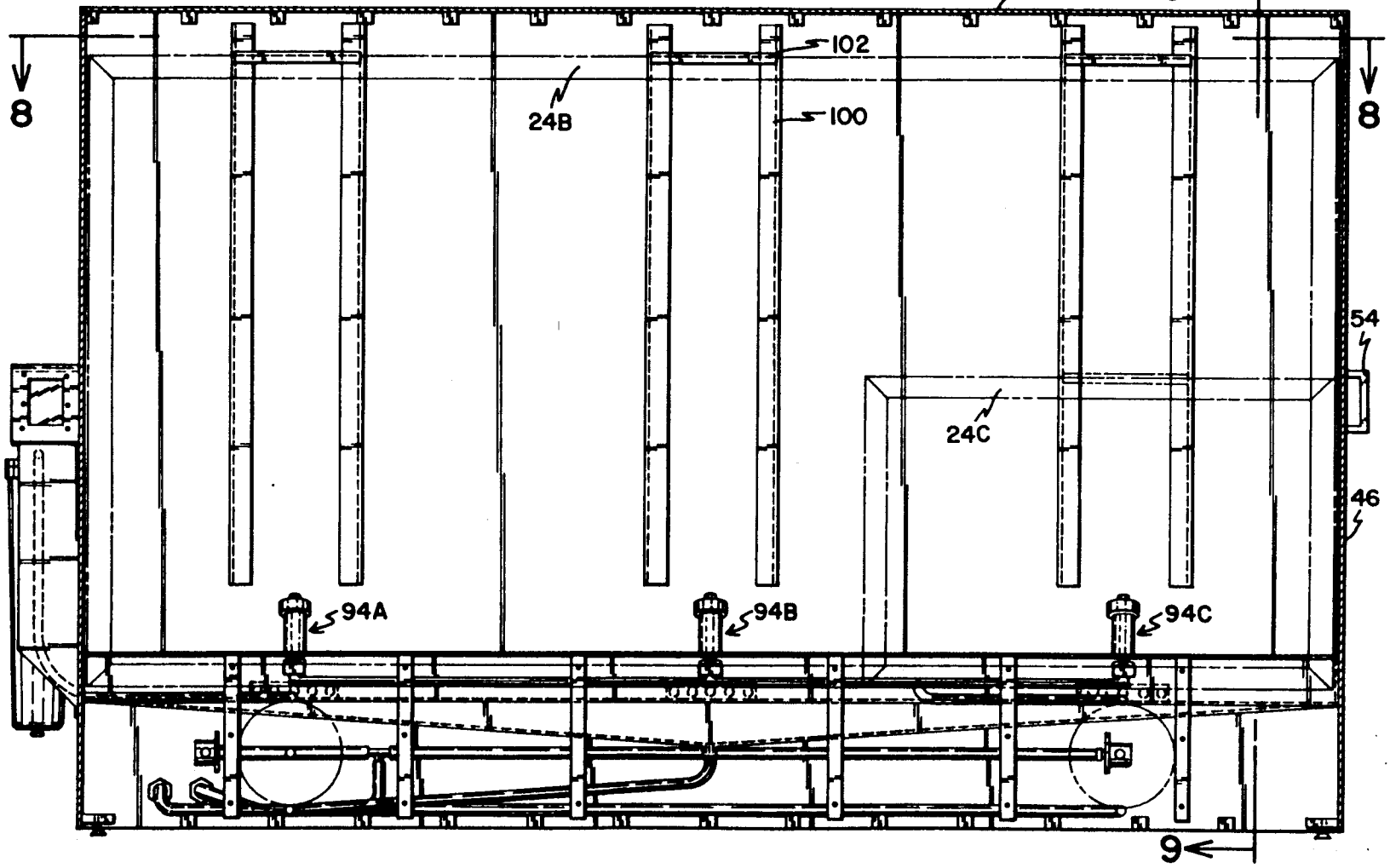
FIG. 7 is a front elevation sectional illustration of a cleaning cabinet having a plurality of fixed location scanning spray heads arranged for simultaneous or switched operation.

FIG. 7 illustrates another embodiment of cleaning cabinet 40 comprising a plurality of scanning spray heads 94*a*, 94*b*, and 94*c*. Also included in the embodiment of cleaning cabinet 40 illustrated in FIG. 7 is a plurality of retaining rails 100 and retaining platforms 102. As is shown in shadow lines, this embodiment of cleaning cabinet 40 is constructed and arranged to accommodate variously sized screen printing plates 24*b* and 24*c*. Indeed, the embodiment of cleaning cabinet 40 illustrated in FIG. 7 may also optimally comprise access means located on a side wall rather than on a top wall in order to provide a lower lift-over height for screens of very large size. As is shown in FIG. 7, sidewall 46 comprises access means denoted by handle means 54. Although screen printing plate 24*c* represents a typical screen printing plate having size dimensions of 25 inches height and 36 inches length, it is understood that both larger and/or smaller size screen printing plates may be accommodated by such a cleaning cabinet 40.

Figure 8:
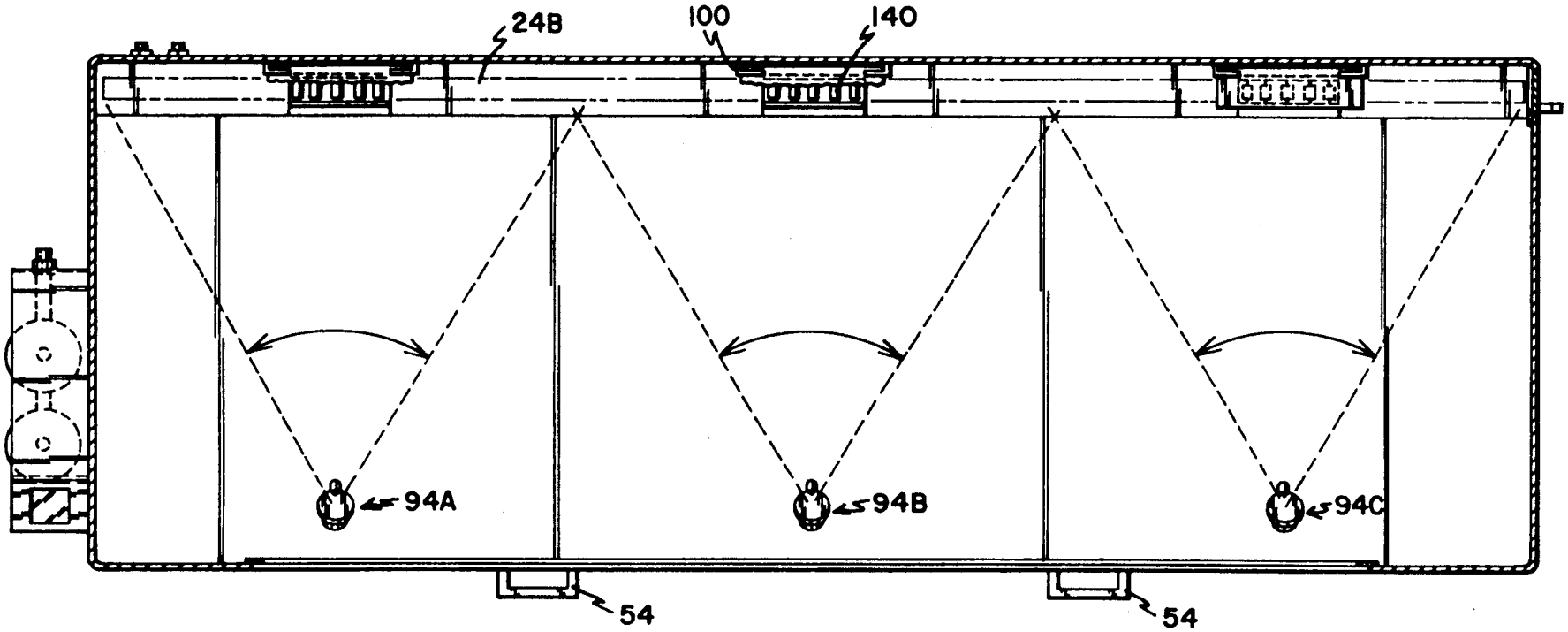
FIG. 8 is a top plan view of the cleaning cabinet and spray head configuration illustrated in FIG. 7 corresponding generally to lines 8—8 of FIG. 7.

FIG. 8 illustrates an optional spray pattern integration of a plurality of scanning spray heads 94. This integration pattern may be preprogrammed by conventional programming means and digital logic controls so that only a predetermined number of scanning spray heads 94 are in simultaneous operation and so that only a minimum amount of spray overlap of sprayed and pressurized cleaning fluid exists. Roller means 140 may also be provided to assist in placement of large sized screen printing plates 24*b*. As illustrated in FIG. 8, roller means 140 may be attached to retaining rails 100 in a manner similar to retaining platform 102 mounting illustrated in FIG. 7, e.g. slidable attachment to rails 100.

Figure 9:
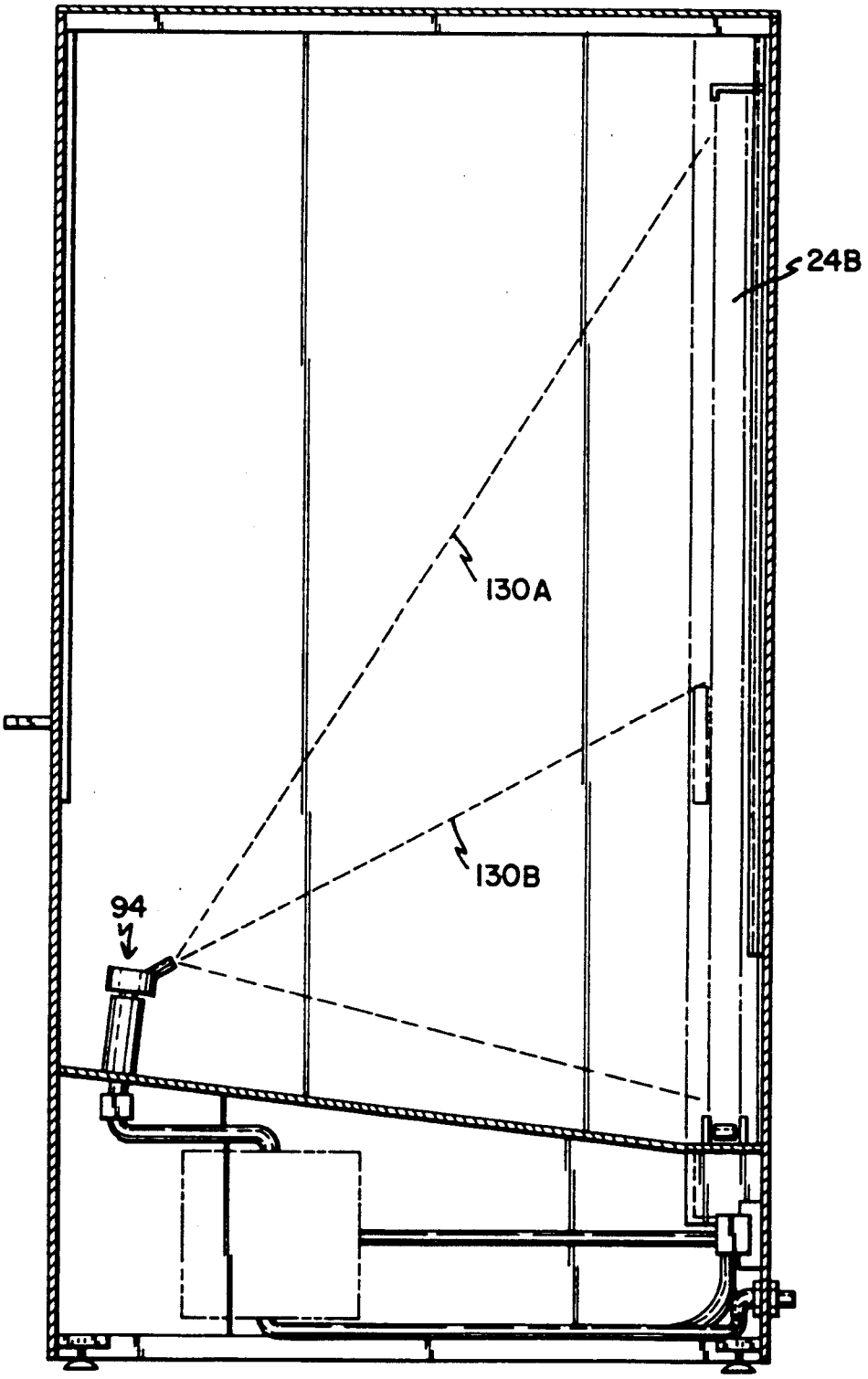
FIG. 9 is a side elevation section view of the cleaning cabinet of FIG. 7 corresponding generally to lines 9—9 of FIG. 7.

FIG. 9 illustrates a first optional vertical spray height range of coverage of cleaning fluid dispensed from scanning spray head 94. Spray pattern height 130*a* would be preferred for a very tall screen printing plate 24*b*, whereas spray pattern height 130*b* would be preferable for a screen printing plate having a lower height, such as screen printing plate 24*c* illustrated in FIG. 7. It is understood that various scanning spray heads 94 may be preprogrammed so as to provide optimal dispersion of cleaning fluid only over the desired surface area of the screen printing plate to be cleaned. This not only enhances flexibility of cleaning cabinet 40 and its related cleaning systems, but it also promotes more efficient use of materials and less waste during the cleaning process. Thus, a programmable scanning spray head 94 comprises means for controlling both or either vertical and horizontal motion.

Figure 10:
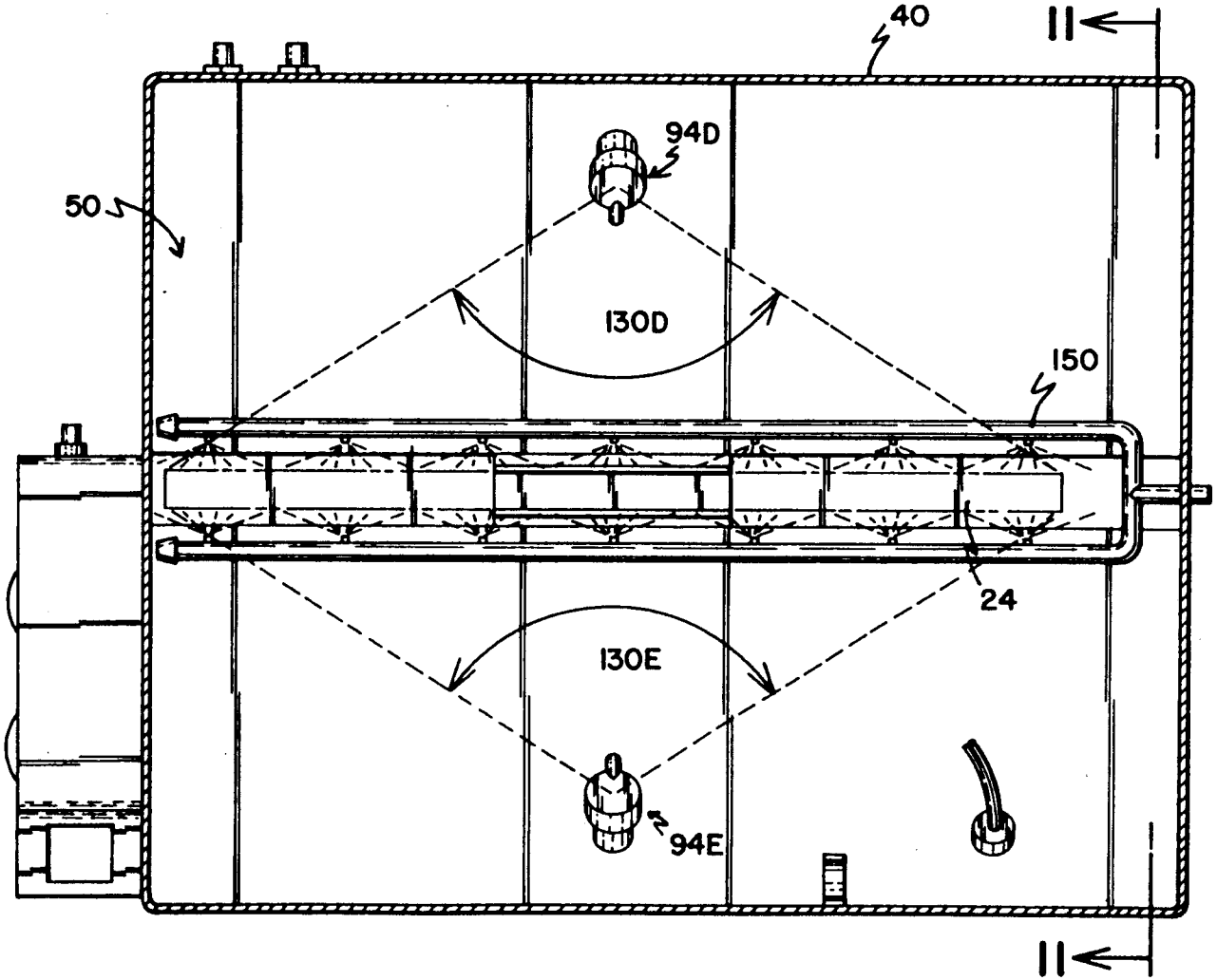
FIG. 10 is a top plan view illustrating spray pattern ranges of a double sided cleaning cabinet, having a plurality of opposing scanning spray heads in combination with a secondary rinse bar.
Figure 11:
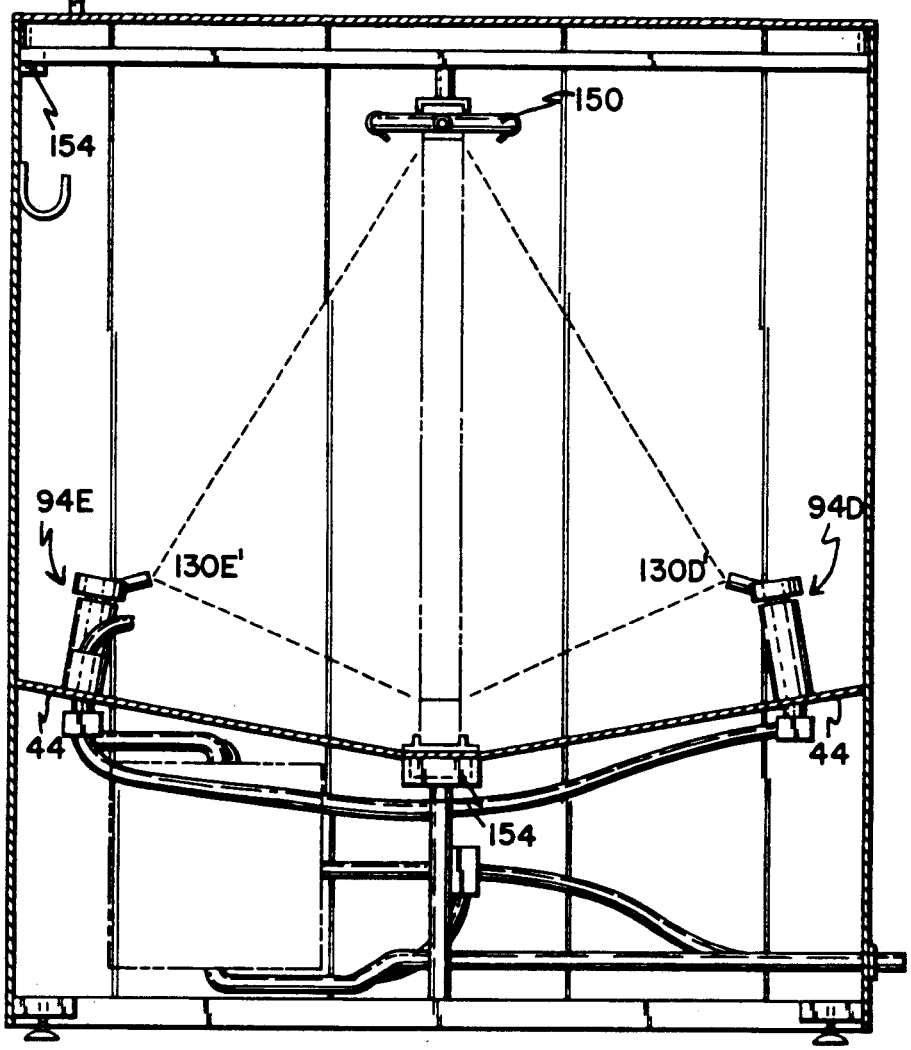
FIG. 11 is a side elevation section view of the cleaning cabinet illustrated in FIG. 10 corresponding generally to lines 11—11 of FIG. 10.

Referring to FIG. 10, yet another embodiment of cleaning cabinet 40 is disclosed in which a plurality of substantially opposite facing single point scanning spray heads 94*d*, 94*e* are provided. As illustrated, scanning spray heads 94*d*, 94*e* are positioned on opposite sides of internal chamber 50 so that each scanning spray head will operably discharge cleaning fluid against opposing sides of representative screen printing plate 24, as illustrated by optional horizontal spray pattern coverages 130*d*, 130*c*. This configuration of scanning spray heads 94*d*, 94*e* provides very efficient means for fully cleaning screen printing plate 24 from both sides, while only requiring a very low power and low pressure pumping system. Indeed, through use of switching and control logic, means are provided for alternating the discharge of cleaning fluids from either scanning spray head 94*d* or scanning spray head 94*e*. This optimizes not only the cleaning of screen printing plate 24 but also the power utilization of the entire system. In other words, it is not necessary to increase the power or pumping requirements in order to achieve highly effective dual side cleaning of screen printing plates. FIG. 11 is a side elevation section view of cleaning cabinet 40 illustrated in FIG. 10, corresponding generally to lines 11—11 of FIG. 10. As shown in FIG. 11, this dual sided configuration of scanning spray heads 94*d*, 94*e* may be arranged such that the respective vertical spray pattern coverages 130*d*', 130*e*', of each of the scanning spray heads completely cleans the vertical screen area of screen printing plate 24. FIG. 10 and FIG. 11 each further illustrate the optional use of water wash down bar means 150 for enhancing the removal of cleaning fluids from screen printing plate 24. FIG. 11 also illustrates a preferred dual pitch or slope of the opposing sides of bottom wall 44. Multiple slope orientations of bottom wall portions are utilized within the scope of this cleaning cabinet invention. Once again, this promotes gravity draining of cleaning fluid, water, and debris removed from screen printing plate 24 and collection of same in a cavity drain area 154. The removal of effluent is accomplished in substantially the same manner by use of the drain pump arrangement described above. What is shown therefore is a screen printing plate cleaning cabinet 40 wherein a dispensing system comprises first and second single point scanning spray heads 94*d*, 94*e* located in substantially opposing relation for discharging cleaning fluid against screen printing plate first and second sides.

Figure 12:
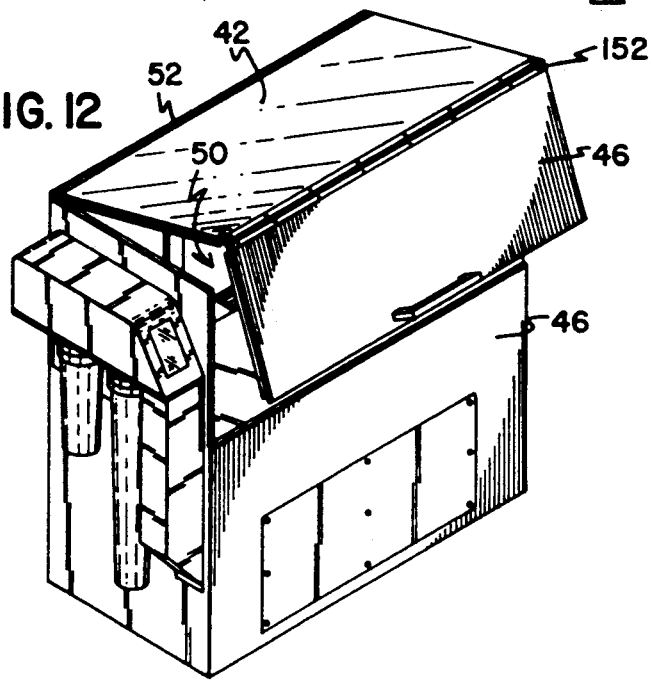
FIG. 12 is a front perspective view of a cleaning cabinet having double hinged access means for minimizing liftover height.

FIG. 12 illustrates an alternate embodiment access means or cover for preferred cleaning cabinet 40. As illustrated, access means may comprise a dual hinge assembly in which hinge 52 is assisted by hinge 152 so that a portion of front facing sidewall 46 is openable along with top wall 42 to further enhance usability and reduce lift-over height requirements, thus facilitating the insertion and removal of screen printing plates from internal chamber 50.

Various configurations of powered operation are available for the subsystems of the present invention. Representative combinations of such subsystem operations are disclosed in FIG. 13, which illustrates a digital control logic scheme for cleaning cabinet 40. As indicated in FIG. 13 and as also shown in FIG. 11, tilt switch 154 is provided so that when access means or top wall 42 is opened then the tilt switch logic prevents automatic wash cycles from occurring. Conversely, tilt switch activation permits operation of manually operated brush valve which is an optional connection to manual scrubber connection 76.

Figure 14:
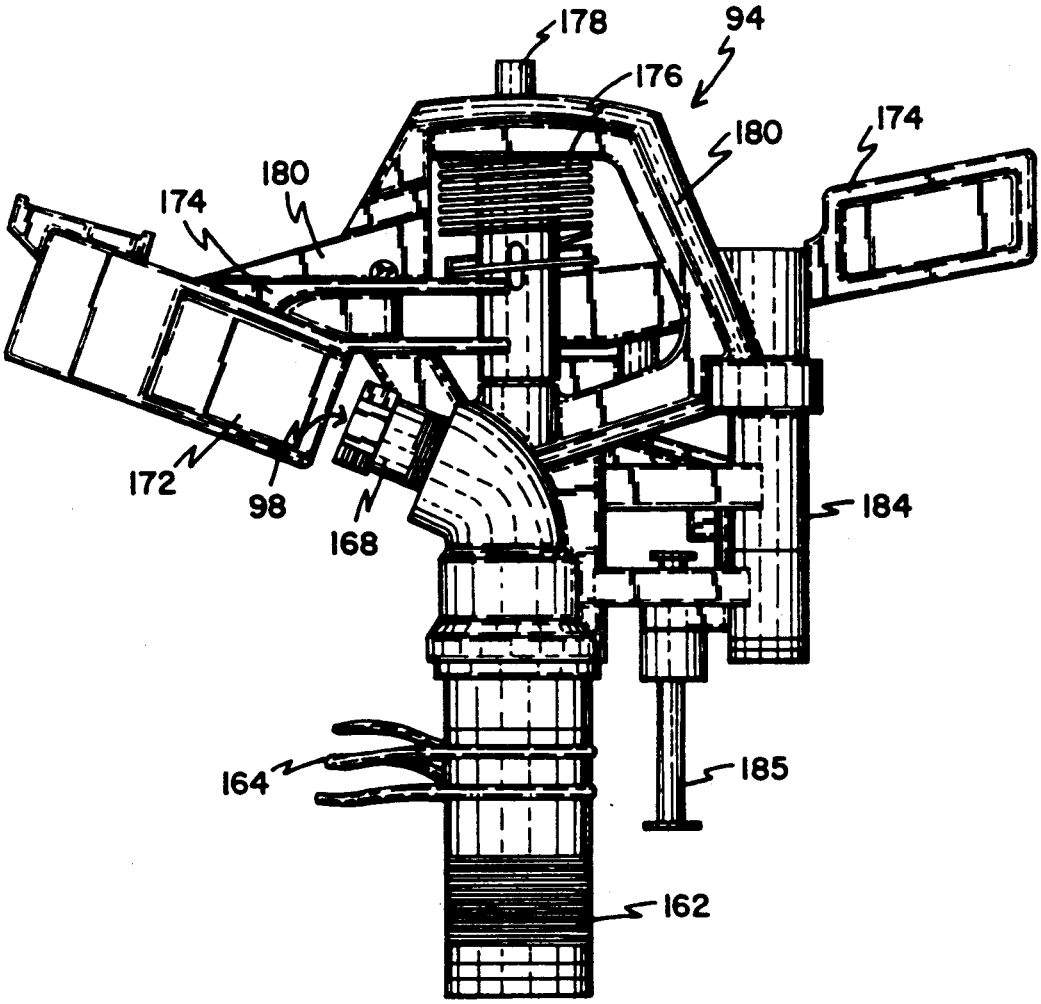
FIG. 14 is a side elevation view of a representative spray head having scan limit stops and a reversing mechanism.

As previously discussed, cleaning cabinet 40 comprises spray heads means 74. Spray head means 74 may comprise a variety of means for moving a scanning spray head 94 to achive a desired spray pattern. For example, self powered scanning spray head 94 illustrated in FIG. 14 incorporates lawn sprinkler technology to achieve horizontal scanning action. Indeed, a conventional lawn sprinkler may be utilized in cleaning cabinet 40 with certain modifications. FIG. 14 illustrates a model of a conventional lawn sprinkler commercially available, as for example a model P25 sold by Nelson Irrigation Corporation or Walla Walla Sprinkler Company. It is understood that numerous other products utilizing fluid powered movement may be used within cleaning cabinet 40 to achieve the objectives within the spirit and scope of this invention. Self powered scanning spray head 94 shown in FIG. 14 comprises connection means 162 for fastening to a standpipe, such as standpipe 92 shown in FIG. 3. Scan limit stops 164 are provided to control or limit the horizontal movement of nozzle 98 and the corresponding spray pattern. Preferred scan limit stops 164 comprise finger adjustable scan limit stops for ease of adjustment. Preferred nozzle 98 provides a vertically oriented elongate spray pattern. This may be achieved by substituting a fan spray head 168 comprising shaping means for shaping a vertically oriented spray pattern rather than a horizontal or circular pattern. Moreover, a preferred spray pattern comprises an 80° fan spray range. However, it is acknowledged and understood that other spray arcs or ranges of spray pattern are contemplated and hereby considered disclosed within this invention.

Various modifications may be required of conventional lawn sprinkler mechanisms in order to accommodate particular fan spray heads 168 used in combination with cleaning cabinet 40. For example, it may be necessary to trim or otherwise alter the shape or length of vane member 172 so that it does not strike fan spray head 168 or nozzle 98. Self powered scanning spray head 94 vane member 172 is contacted by cleaning fluid discharged from nozzle 98. Vane member 172 is connected to drive arm 174 which is operably connected to spring 176 surrounding pin 178. As cleaning fluid contacts vane member 172, drive arm 174 is moved into contact with impact cage 180 and imparts rotational horizontal movement to scanning spray head 94. This movement results in a horizontal motion being imparted to a corresponding pattern of cleaning fluid emitted from dispenser nozzle 98. Reversing mechanism 184 cooperates with reversing actuator rod 185 and spring 176 to return scanning spray head 94 to a predetermined point, commonly the beginning point, of a spray pattern.

Figure 15:
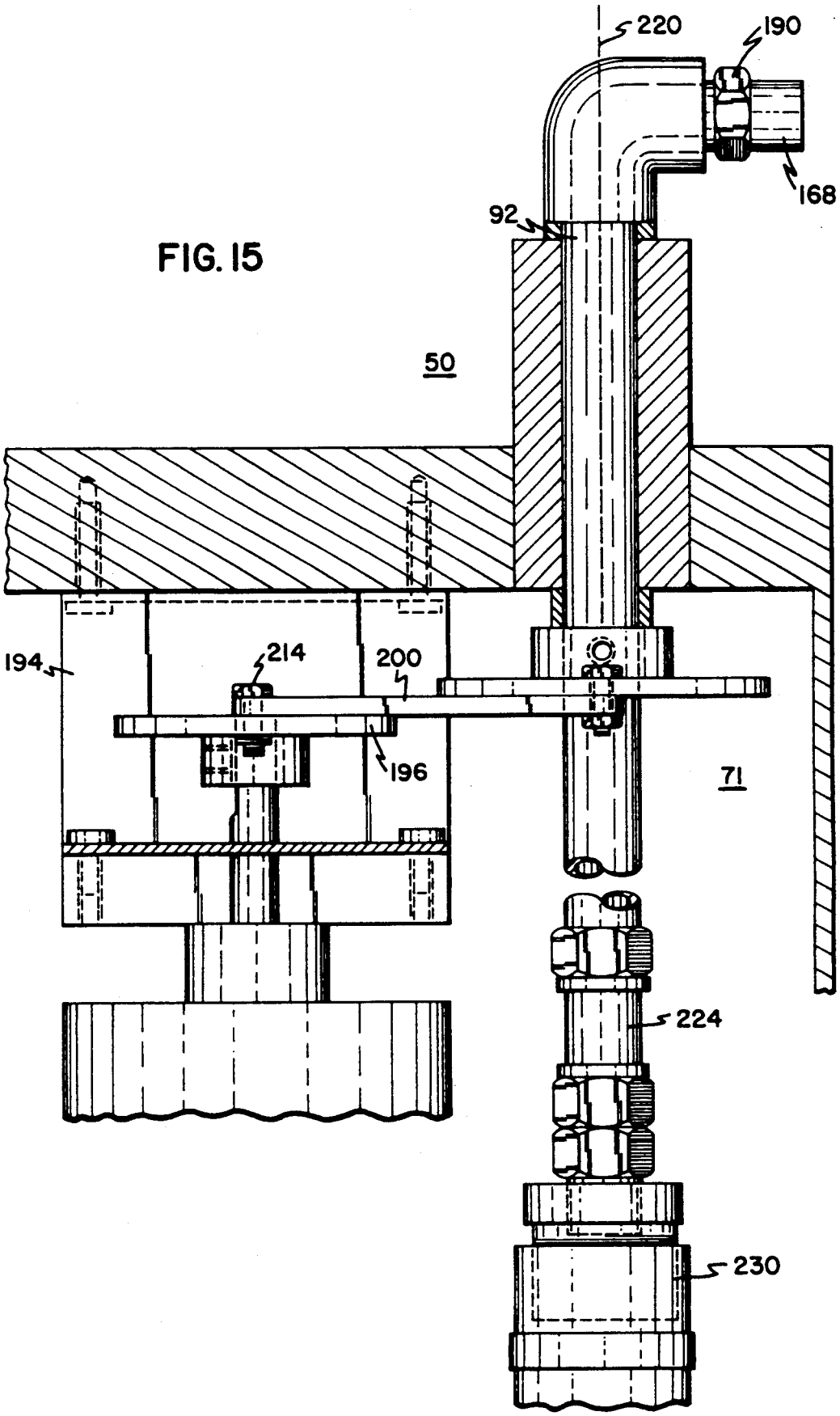
FIG. 15 is a side elevation view of an electric motor actuated spray head drive.

FIG. 15 is a side elevation view of an electric motor actuated spray head drive. A spray head connection 190 is shown extending from standpipe 92. A representative fan spray head 168 is shown connected to spray head connection 190. Standpipe 92 provides means for fluid flow of cleaning fluid from a cleaning fluid source to fan spray head 168 from which dispersion of the cleaning fluid is achieved. It is understood that a portion of standpipe 92 extends from internal chamber 50 into equipment cavity 71. Within equipment cavity 71, a motor 194, preferably an electric motor, and more preferably a low speed alternating current gear driven motor, is provided.

Figure 16:
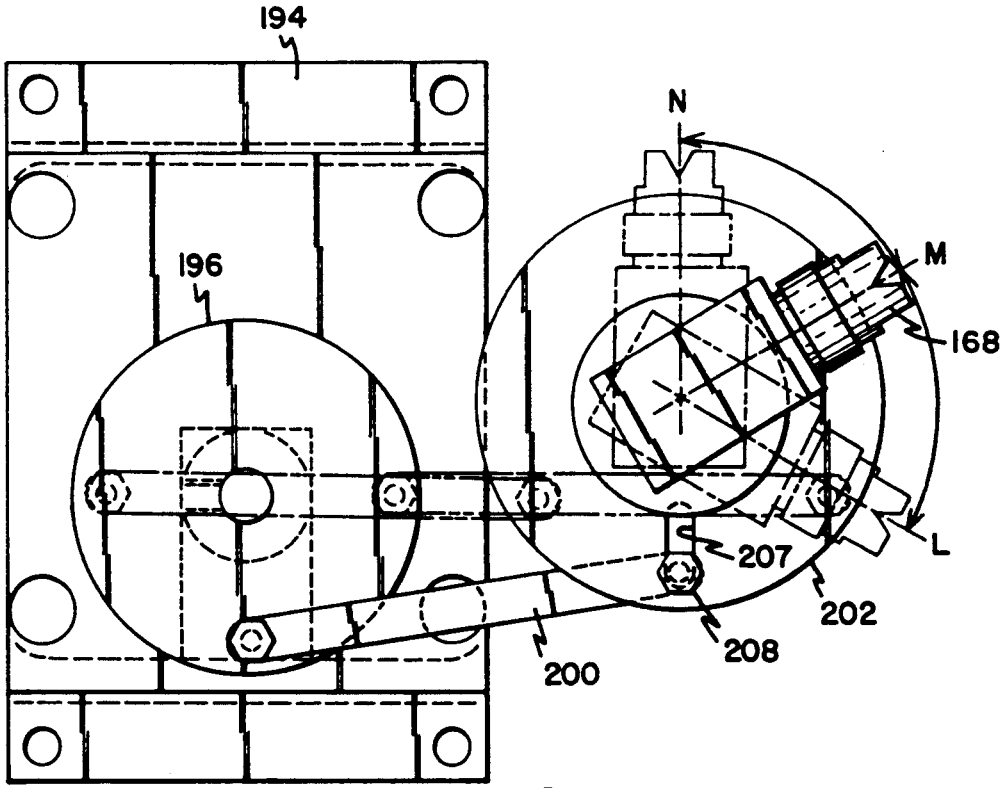
FIG. 16 is a top plan view of an electric motor actuated spray head drive analogous to that illustrated in FIG. 15.

Referring to the top plan view shown in FIG. 16 (corresponding generally to the side elevation view of FIG. 15) it may be seen that motor 194 is constructed and arranged for imparting circular motion to drive cam 196. Linkage arm 200 is connected to drive cam 196 and scan head cam 202. As illustrated in FIG. 16, the point of connection of linkage arm 200 with scan head cam 202 may optionally comprise slot means 207 comprising a slot or cutout in scan head cam 202 for adjusting the angular movement imparted to scan head cam 202 by linkage arm 200 movement. This limitation in turn alters the arc or range of the spray pattern emitting from fan spray head 168. Adjustment means 208 may be used for tightening or loosening the point of connection of linkage arm 200 within slot means 207. In operation, motor 194 may comprise a variety of motors. A low power electrical motor may be used. As drive cam 196 is rotated circularly about center point 214 then linkage arm 200 imparts rotational movement to scan head cam 202 about axis 220 which moves fan spray head 168 between a range of positions such as indicated in FIG. 16 as positions L, M, and N. The range arc between positions L, M, and N as illustrated in FIG. 16 is intended as representational only and does not comprise limitations on the spray pattern range possibilities within the scope of this invention. Standpipe 92 is preferably connected to swivel assembly 224, shown in FIG. 15, to facilitate rotation of the entire standpipe 92. Valve means 230 provides connection of standpipe 92 with a cleaning fluid source.

Figure 17:
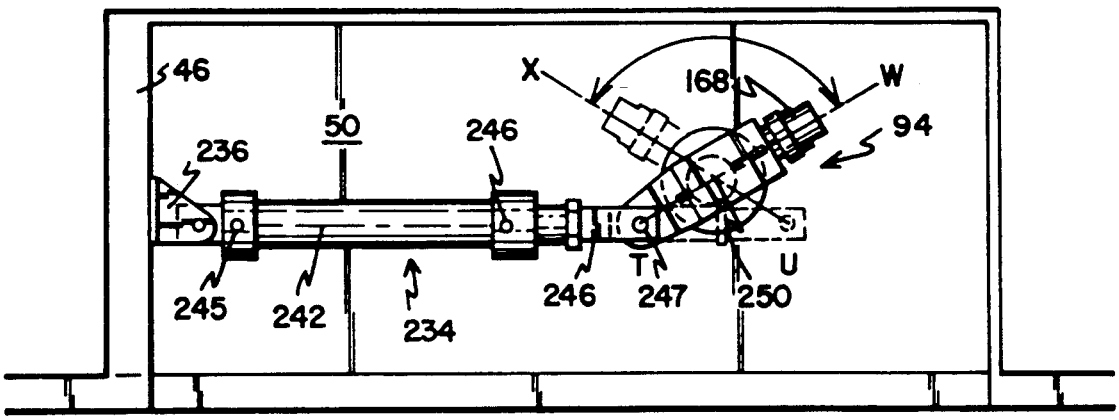
FIG. 17 is a top plan view of an air cylinder actuated spray head drive mechanism.

FIG. 17 illustrates yet another means for providing horizontal rotation or movement of scanning spray head 94 to create desired spray patterns across screen printing plates. FIG. 17 is a top plan view of an air cylinder actuated spray head drive. In this embodiment, the spray head drive assembly 234 may be housed entirely within cleaning cabinet 20 internal chamber 50, or portions of it may extend through appropriate linkages to equipment cavity 71. As illustrated in FIG. 17, spray head drive assembly 234 is movably attached by clevis 236 to wall member 46. Air cylinder means 242 is provided with inlet/outlet ports 245, 246 for receiving and exhausting pressurized air to and from air cylinder means 242. As illustrated, air cylinder means 242 comprises a double acting air cylinder means but may alternately comprise a variety of piston or cylinder configurations to achieve the desired motion.

Piston member 246 reciprocates in and out of air cylinder means 242 and is attached at end area 247 to scanning spray head 94. Scanning spray head 94 is pivotally connected to a standpipe extending normally therefrom. The standpipe and scanning spray head 94 pivotally rotate about axis point 250 within a predetermined arc of movement that is regulated by the reciprocating stroke length of piston member 246. For example, as piston member 246 moves between position T and position U, then scanning spray head 94 moves between positions such as those positions denoted as W and X. Once again, the precise range arc as shown in FIG. 17 is illustrative only and a variety of range arcs are possible depending on the requirements of the particular system manufactured according to this invention. It is also possible to regulate the speed with which scanning spray head 94 rotates about axis point 250. This may be accomplished by use of a flow restrictor or the like within a pneumatic source supply line leading to air cylinder means 242. Thus, it is possible to regulate the scan rate of scanning spray head 94 across a variety of screen printing plates by limiting the supply (or even the exhaust) gas through needle valves or other restriction means, such as a dashpot or other air exiting limitation structures.

Spray head means 74 shown throughout FIGS. 1–17 may also further comprise means for vertical movement. A variety of vertical control means may be utilized. At least one preferred method of vertically moving scanning spray head 74 is to employ a ratchet and pawl mechanism which may also be powered by an air cylinder comparable to that shown in FIG. 17. Electrical control may also be utilized to provide a vertical scan to scanning spray head 94. Accordingly, a scanning spray head having a limited scan may be utilized within cleaning cabinet 20. Such a combination of spray and nozzle technology with cleaning cabinet 20 provides excellent means for scanning a horizontal area of a screen printing plate, returning to a starting point, moving vertically down or up and recommencing a horizontal scan. This sequence may be repeated a number of times to achieve a focused cleaning through use of limited scan capabilities which accurately simulates the technique which would be used by a human operator to effectively clean a screen printing plate.

Although specific and mechanical configurations have been illustrated and described for the preferred embodiments of the present invention set forth herein, it will be appreciated by those of ordinary skill in the art that other arrangements which are calculated to achieve the same purpose may be substituted for the specific configurations shown. Thus, while the present invention has been described in connection with the preferred embodiments thereof, it will be understood that many modifications will be readily apparent to those of ordinary skill in the art, and the disclosed configurations herein are intended to cover any adaptations or variations thereof. Therefore, it is manifestly intended that the inventive aspects described herein may be limited only by the claims and equivalents thereof. Accordingly, it is also understood that while certain embodiments of the present invention have been illustrated and described, the invention is not to be limited to the specific forms or arrangement of parts herein described and shown.

What is claimed is:

1. A screen printing plate cleaning cabinet comprising:

a) wall means comprising a top wall, a bottom wall, and side walls constructed and arranged to provide a fluid tight internal chamber suitable for cleaning a screen printing plate therein;

b) access means extending through said wall means for positioning a screen printing plate in said internal chamber;

c) retaining means located within said internal chamber for retaining a screen printing plate placed therein;

d) a dispensing subsystem comprising spray head means, said spray head means having a first single point scanning spray head for discharging a cleaning fluid against a screen printing plate first side to clean said screen printing plate; and e) filter and drain subsystem means for removing residue and cleaning fluid from said internal chamber.

2. A screen printing plate cleaning cabinet according to claim 1 wherein said wall means comprise translucent material.

3. A screen printing plate cleaning cabinet according to claim 2 wherein said wall means translucent material comprises material selected from the group consisting of non-filled polyethylene, non-filled polypropylene, polymethylpentine, polyolefin, polystyrene, and polysulfone.

4. A screen printing plate cleaning cabinet according to claim 1 wherein said access means comprises an openable hinged top wall constructed and arranged for permitting placement of a screen printing plate into said cleaning cabinet internal chamber.

5. A screen printing plate cleaning cabinet according to claim 1 wherein said access means comprises an openable side wall portion for sliding a screen printing plate into said cleaning cabinet internal chamber.

6. A screen printing plate cleaning cabinet according to claim 1 wherein said filter and drain subsystem comprises air driven pumps.

7. A screen printing plate cleaning cabinet according to claim 1 wherein said filter and drain subsystem comprises piping means constructed and arranged for recirculation and re-use of said cleaning fluid.

8. A screen printing plate cleaning cabinet according to claim 1 wherein said spray head means comprises a selfpowered scanning spray head.

9. A screen printing plate cleaning cabinet according to claim 1 wherein said dispensing subsystem comprises a plurality of single point scanning spray heads.

10. A screen printing plate cleaning cabinet according to claim 1 wherein said dispensing subsystem comprises a manually operated chemically resistent flow-through scrub brush.

11. A screen printing plate cleaning cabinet according to claim 1 wherein said dispensing subsystem further comprises a second single point scanning spray head located substantially opposite said first single point scanning spray head for discharging a cleaning fluid against a screen printing plate second side.

12. A low pressure solvent cleaning system for cleaning screen printing plates comprising:

a) cabinet means comprising single thickness plastic wall members constructed and arranged for providing a fluid tight internal chamber;

b) access means located in a portion of said wall members to provide access into said cabinet means internal chamber for placement and removal of a screen printing plate;

c) a dispensing subsystem comprising a scanning spray head for low pressure discharge of a cleaning fluid against a screen printing plate located within said cabinet means internal chamber; and d) filter and drain subsystem means connected to said cabinet means for removing residue and cleaning fluid from said cabinet means internal chamber.

13. A low pressure solvent cleaning system according to claim 12 wherein said dispensing subsystem dispenses cleaning fluid at a pressure of about 100 pounds per square inch.

14. A low pressure solvent cleaning system according to claim 12 wherein said cabinet means plastic wall members comprise translucent plastic wall members.

15. A low pressure solvent cleaning system according to claim 12 further comprising a digital control subsystem operably connected to said cabinet means for providing programmable wash control cycles of cleaning fluid discharge from said dispensing subsystem.

* * * * *